US005647782A

United States Patent [19]

Henry

[11] Patent Number: 5,647,782

[45] Date of Patent: Jul. 15, 1997

[54] APPARATUS FOR FORWARD FACING BOAT ROWING

[76] Inventor: Harold S. Henry, 7511 - 329th SE., Fall City, Wash. 98024-6700

[21] Appl. No.: 539,167

[22] Filed: Oct. 4, 1995

[51] Int. Cl.[6] ..... B63H 16/04

[52] U.S. Cl. ..... 440/102; 440/104

[58] Field of Search ..... 440/101–110; 416/70 R, 72, 74; 482/72, 73

[56] References Cited

U.S. PATENT DOCUMENTS

| | | | |
|---|---|---|---|
| 49,930 | 9/1865 | Smith . | |
| 88,013 | 3/1869 | Connor . | |
| 2,189,975 | 2/1940 | Carlson | 440/102 |
| 2,338,555 | 1/1944 | Vander Meer | 440/102 |
| 4,383,830 | 5/1983 | Cartwright . | |
| 4,623,314 | 11/1986 | Waugh . | |
| 4,776,821 | 10/1988 | duPont . | |
| 4,867,718 | 9/1989 | duPont . | |
| 4,943,250 | 7/1990 | duPont . | |
| 5,215,482 | 6/1993 | Henry . | |

FOREIGN PATENT DOCUMENTS

| | | | |
|---|---|---|---|
| 3019514 | 11/1981 | Germany | 440/105 |
| 158752 | 11/1919 | United Kingdom . | |

*Primary Examiner*—Edwin L. Swinehart

*Attorney, Agent, or Firm*—Christensen O'Connor; Johnson & Kindness PLLC

[57] ABSTRACT

An apparatus for use in forward facing rowing of a boat having oars mounted ahead of the oarsman and having a seat fixedly secured in the boat is disclosed. The apparatus comprises an inboard support assembly and an outboard support assembly. The outboard support assembly is connected to boat oars for pivotal movement of the oars with respect to the outboard support assembly in at least horizontal and vertical planes, and also allows rotational movement of the oars with respect to the outboard support assembly. The inboard support assembly is comprised of a mounting bracket slidably secured within the boat, as well as a first elongate support and a second elongate support, both of which are pivotally attached to the mounting bracket for horizontal movement of the first elongate support and the second elongate support. The outboard support assembly comprises an oar support pivotally connected to boat oars and to the first elongate support and to the second elongate support for horizontal movement of the oar support. The outboard support assembly also includes an oar brace pivotally connected to the second elongate support for at least horizontal and vertical movement of the oar brace. The oar brace is pivotally connected to boat oars for movement of boat oars with respect to the oar support in at least horizontal and vertical planes and for rotational movement of boat oars with respect to the oar brace.

24 Claims, 14 Drawing Sheets

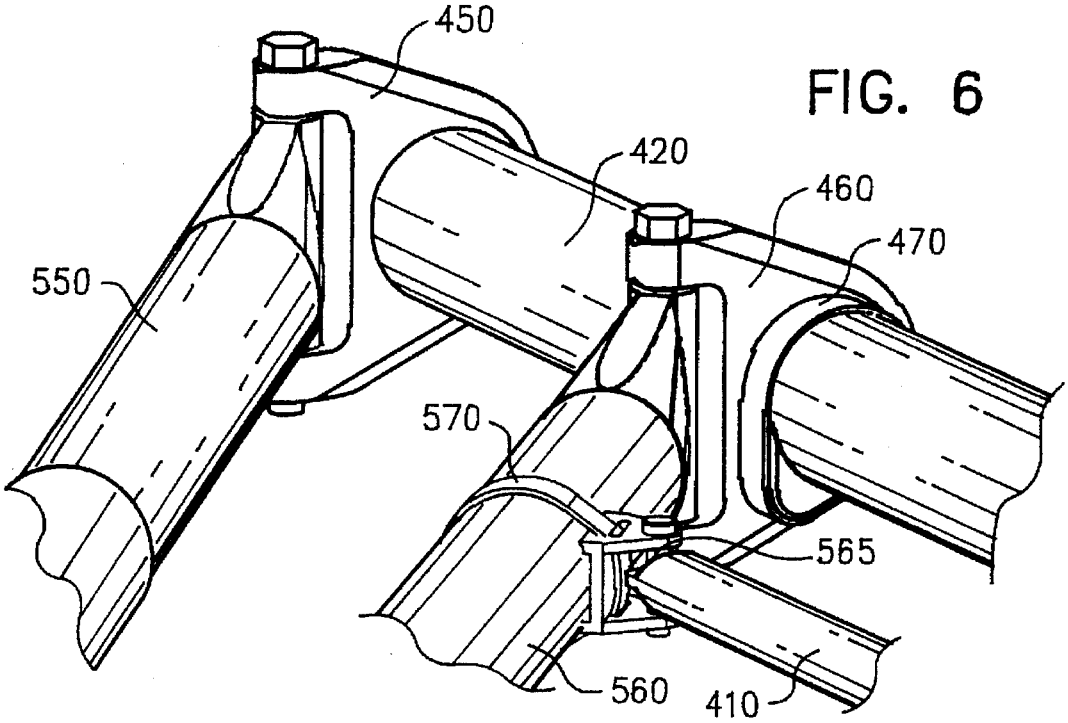
FIG. 6
FIG. 7
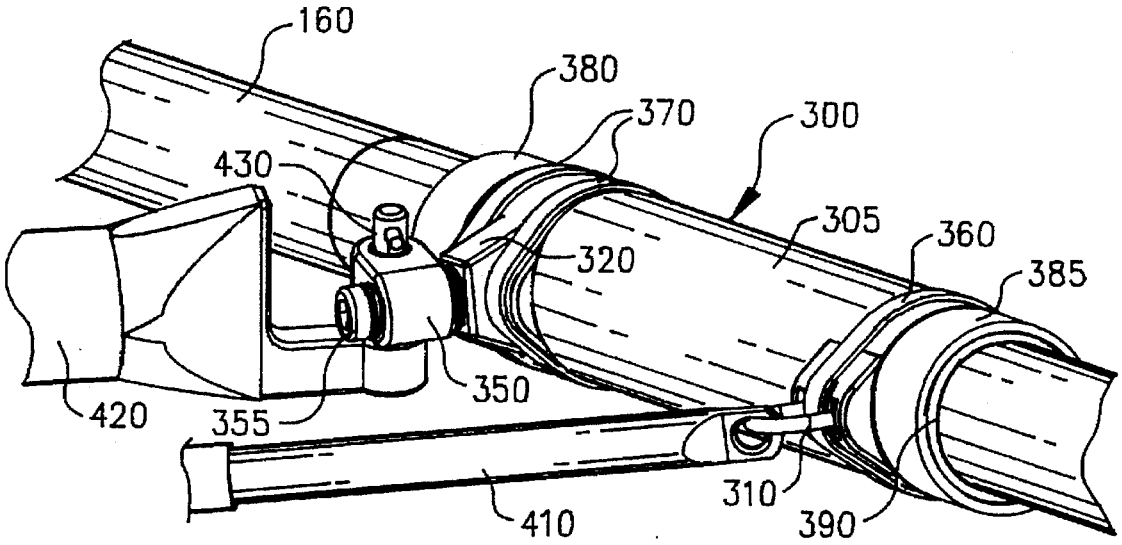

APPARATUS FOR FORWARD FACING BOAT ROWING

BACKGROUND OF THE INVENTION

The present invention pertains to an apparatus for forward-facing rowing of a boat or racing shell.

The benefits of forward-facing rowing, including safer and more enjoyable rowing, are readily apparent. Patents that disclose various types of mechanisms for rowing facing forward include U.S. Pat. No. 5,215,482 issued to Henry; U.S. Pat. Nos. 4,943,250, 4,867,718, and 4,776,821, all issued to duPont; U.S. Pat. No. 4,623,314 issued to Waugh; and U.S. Pat. No. 4,382,830 issued to Cartwright.

U.S. Pat. No. 5,215,482 issued to Henry discloses an apparatus that has various advantages over previous patents, including the following: (a) it duplicates the rowing motion of conventionally operated oars, including full pivotal oar motion, as well as oar rotation around the oar longitudinal axis that alters the angular orientation of the oar face (known as "feathering"); (b) it provides rowing performance better than the performance attained by conventional rowing by lengthening the effective oar radius, which reduces the arc described by the oar blade in traversing a stroke of standard length (from an arc of about 90° in length to an arc of about 60°; (c) the lengthening of effective oar radius also permits shorter oars to be used effectively, which allows a rower to navigate narrower waterways; (d) it can be adjusted to permit the rower to raise the oar blades higher above the water than conventional rowing apparatus, which makes rowing possible in rougher water than can be accommodated by conventional rowing apparatus; and (e) it can be easily constructed and maintained in such fashion that very little energy is lost to friction even under the heaviest use.

Although the apparatus disclosed in the aforementioned patent issued to Henry has the important advantages listed above, it does not have the advantage that it can easily be installed in existing boats, without need of connections to the boat outside of the cockpit where the rower sits.

Furthermore, the Henry patent does not have the advantage that the rower can turn the boat as easily and rapidly by pulling on one oar more than the other, as is the case when the oars pivot near the midpoint of the boat.

Also, the Henry patent does not have the advantage that the ends of the oars may effectively be mounted low enough to provide for easy balance of the boat and an unobstructed forward rowing view.

Additionally, the Henry patent does not have the advantage that the radius of the arc described by the blade of the oar may exceed the length of the oar itself, nor that significant adjustment can be made to the leverage achieved at different points during the stroke.

Finally, the Henry patent does not teach an apparatus that reduces the fore-and-aft instability associated with a conventional sliding seat, while still permitting the strength of the rower's legs to be transferred to the motion of the oar blades. Specifically, the Henry patent does not disclose a mechanism whereby the rower's seat may be fixed to the boat, while both the rower's feet and hands may move in the pattern associated with conventional sliding-seat rowing so as to propel the oar-blade efficiently through the water.

A need thus exists for a forward facing rowing apparatus having the advantages over prior art listed above that U.S. Pat. No. 5,215,482 issued to Henry does possess, together with all the advantages listed above that said patent does not possess.

SUMMARY OF THE INVENTION

The present invention is an apparatus for forward facing boat rowing.

The apparatus includes an oarlock assembly which supports the oar at a point in the midsection of the oar between the handle end of the oar and the oar blade, in such fashion that the oar can rotate around its longitudinal axis within the oarlock assembly, but cannot pivot within or slide along its longitudinal axis through the oarlock assembly.

The oarlock assembly attaches to the aft end of an elongate horizontal outboard support assembly in such fashion that the oarlock assembly can pivot in the vertical plane parallel to the longitudinal axis of the oar, and is constrained by the outboard support assembly from pivoting in a horizontal plane.

The forward end of the outboard support assembly attaches to the outboard end of an elongate horizontal inboard support assembly in such fashion that the outboard support assembly can pivot around said end of the inboard support assembly only in a horizontal plane and preferably in a manner constrained by the inboard support assembly.

The inboard end of the inboard support assembly attaches to the top of a support post in such fashion that the inboard support assembly can pivot around said support post in a horizontal plane.

The lower end of the support post attaches rigidly to the forward end of a stretcher assembly on which foot-supports are mounted, where the rower places the feet while rowing.

In the preferred embodiment, the outboard support assembly consists of an elongate oar support element, an elongate oar brace element, and a dual pivot element, while the inboard support assembly consists of an elongate forward support element and an elongate aft support element.

In the preferred embodiment of the present invention, the stretcher assembly is slidably mounted to the bottom of the boat cockpit in such fashion that it moves easily along an axis parallel with the fore-and-aft axis of the boat when pushed or pulled by the rower's legs, but cannot otherwise move or rotate.

In the preferred embodiment, the rower sits in a seat mounted aft of the stretcher assembly. The height of said seat is adjustable by the rower, so that it may rest on the bottom of the boat cockpit to maximize stability, or may be raised above the bottom of the boat cockpit to match the alignment of the rower's feet and body used in conventional sliding-seat rowing, or may be mounted at other heights above the bottom of the boat cockpit to achieve different stroke characteristics. The seat includes a back support which prevents the rower from sliding backwards off the seat, pivotally mounted so that it adapts to the angle of the rower's back.

In the preferred embodiment, the outboard end of the oarlock assembly attaches to the dual pivot element in such fashion that the oarlock assembly can pivot around the dual pivot element in a vertical plane parallel to the longitudinal axis of the oar. The dual pivot element, in turn, attaches to the aft end of the oar support element in such fashion that the dual pivot element can pivot around said end of the oar support element in a horizontal plane.

In the preferred embodiment, the forward end of the oar support element attaches to the outboard end of the forward support element in such fashion that it can pivot freely around said end of the forward support element in a horizontal plane, while the inboard end of the forward support element attaches to the top of the support post in such fashion that it can pivot freely in a horizontal plane around a point ahead of the support post.

In the preferred embodiment, the inboard end of the aft support element attaches to the top of the support post in such fashion that it can pivot freely in a horizontal plane around a point to the rear of the support post. The outboard end of the aft support element attaches to a point in the midsection of the oar support element that falls in the forward half of the oar support element in such a fashion that the aft support element can pivot freely around said point in a horizontal plane.

In the preferred embodiment, the forward end of the oar brace element attaches to a point in the midsection of the aft support element that falls in the outboard half of the aft support element in such a fashion that the oar brace support element can pivot freely around said point in both vertical and horizontal planes. The aft end of the oar brace element attaches to the inboard end of the oarlock assembly in such a fashion that the oar brace support element can pivot freely around said end of the oarlock assembly in both vertical and horizontal planes.

In the preferred embodiment, a grip handle of the oar is offset at an angle from the shaft of the oar in such fashion that the grip handle lies in substantially the same plane as the oar blade, the center point of the center line of the grip handle lies on the longitudinal center line of the oar shaft, and the grip handle rises at an angle between 20 degrees and 70 degrees from horizontal when the oar blade is in the water during the power stroke, so that rotation of the oar for feathering can be most comfortably and precisely accomplished.

In an alternate embodiment of the present invention, the inboard support assembly consists of a single elongate support element, while all other elements are substantially the same as in the preferred embodiment.

In another alternate embodiment of the present invention, the outboard support assembly consists of an elongate oar support element, while the inboard support assembly consists of an elongate forward support element and an elongate aft support element, and the oarlock mechanism consists of two lengths of tube joined rigidly in a "T" shape, with the oar shaft rotating within, but not sliding through, the top of the "T" of the tubes, and the upright of the "T" of the tubes rotating around, but not sliding along, the oar support element.

BRIEF DESCRIPTION OF THE DRAWINGS

These and other features of the present invention will be more fully appreciated when considered in the light of the following specification and drawings in which:

FIG. 6 is a view of the outboard ends of the forward support element and the aft support element of the inboard support assembly, mounted to the oar support element and oar brace element of the outboard support assembly of the present invention, viewed at an angle 15 degrees above horizontal and from the port side of the boat at an angle 20 degrees clockwise from dead astern, at the beginning of the power stroke;

FIG. 7 is a view of the oar support element, the dual pivot element, and the oar brace element of the outboard support assembly mounted to the oarlock assembly of the present invention, viewed at an angle 25 degrees above horizontal and from the port side of the boat at an angle perpendicular to the center line of the boat, at the beginning of the power stroke;

DETAILED DESCRIPTION OF THE PREFERRED EMBODIMENT

The present invention is an apparatus for forward facing rowing of a boat or racing shell.

Figure 1A:
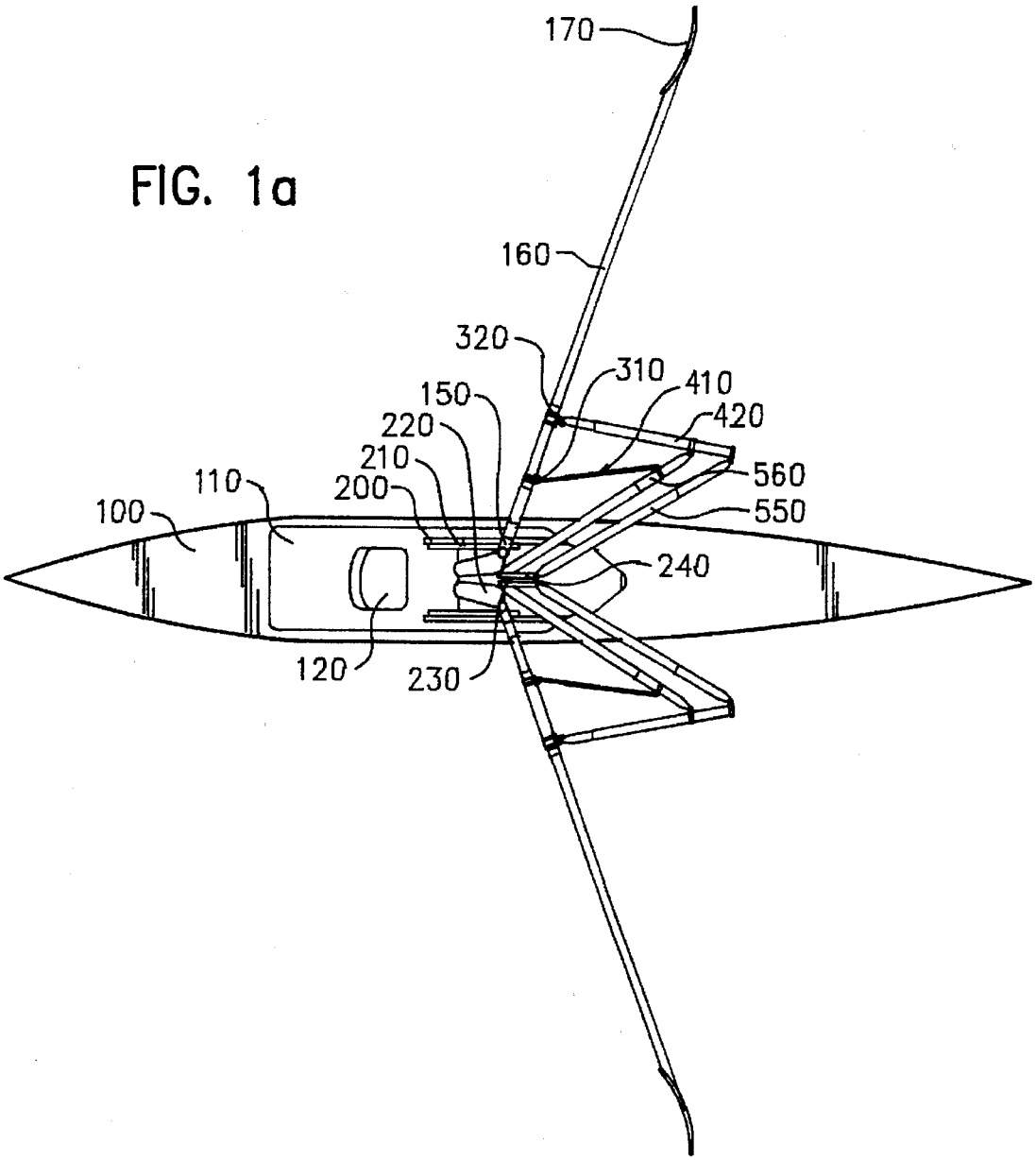
FIGS. 1*a*, 1*b*, and 1*c* are top views of the present invention mounted on a boat and showing respectively the beginning, middle, and end positions of the oar power stroke.

Referring first to FIG. 1*a*, the overall configuration of the present invention is detailed. Boat 100 contains cockpit 110, to the bottom of which seat assembly 120 is fixed, oriented toward the front of the boat.

Foot supports 220 and support post 230 are mounted on a platform 210 which slides in a fore-and-aft direction along two parallel channels 200. At the top of support post 230 are attached mounting brackets 240.

Figure 5:
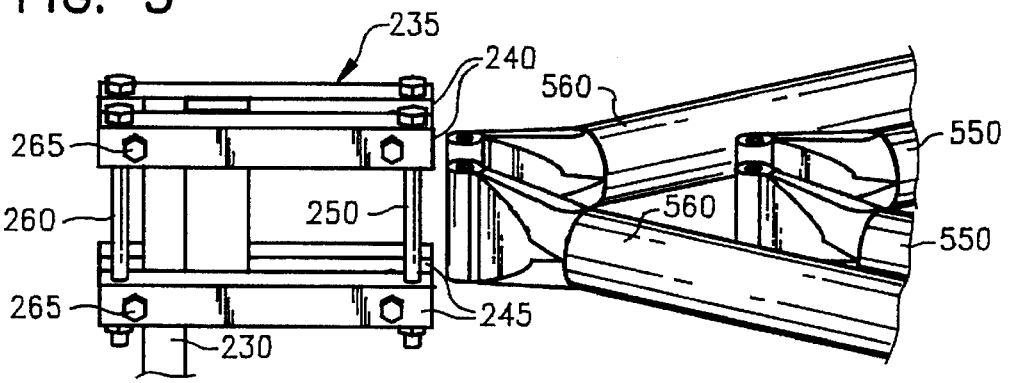
FIG. 5 is a view of the inboard ends of the forward support elements and the aft support elements of the inboard support assembly of the present invention, separated from the top of the support post of the present invention to which they mount, viewed at an angle 20 degrees above horizontal and from the side at an angle perpendicular to the center line of the boat.

The inboard ends of the forward support element 550 and the aft support element 560 are mounted in the mounting brackets 240 in such fashion that they pivot in a horizontal plane, as described in more detail herein and as shown in FIG. 5.

Figure 4:
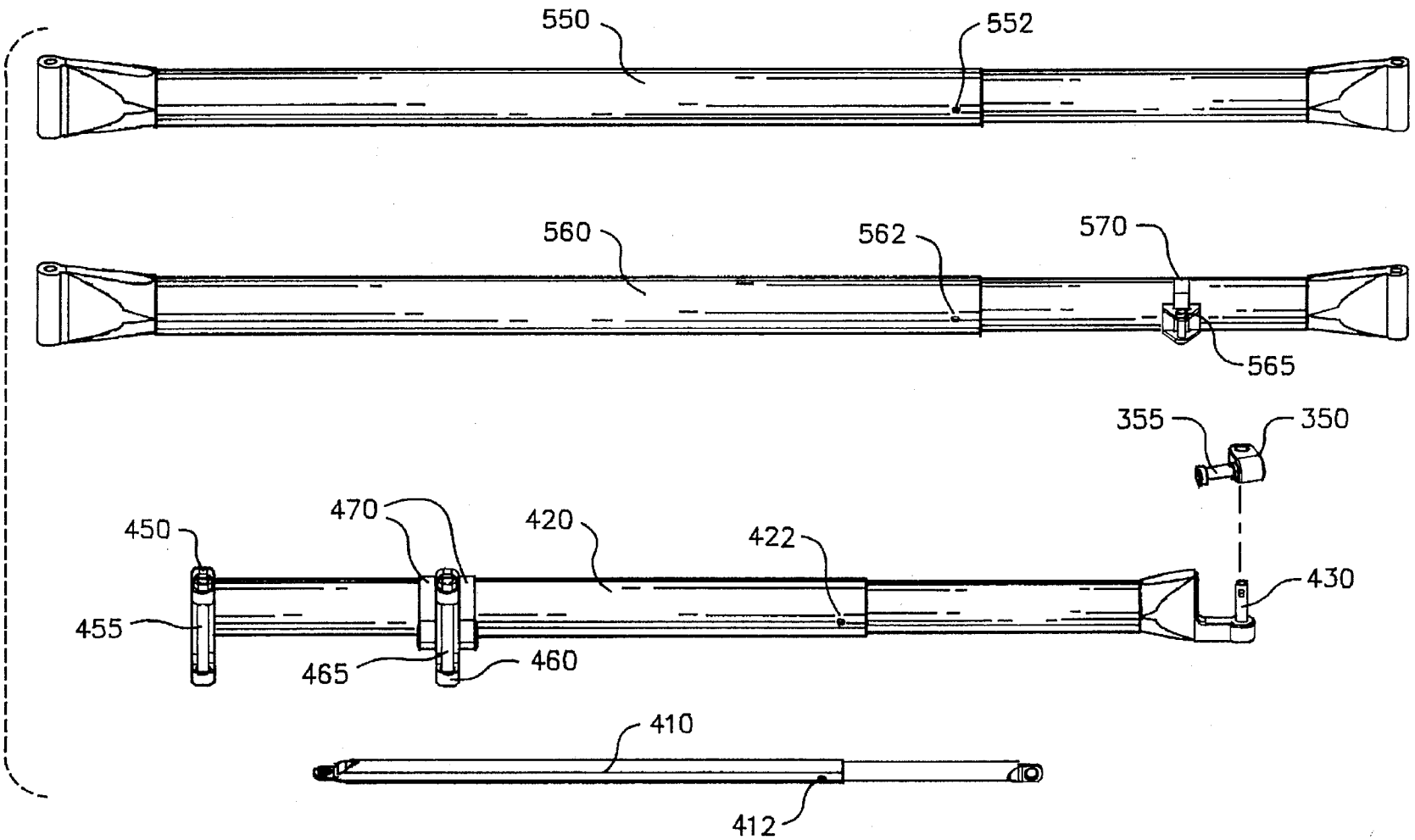
FIG. 4 is a view of the forward support element and the aft support element of the inboard support assembly and the oar support element and oar brace element of the outboard support assembly of the present invention, viewed at an angle 30 degrees above horizontal and from the side at an angle perpendicular to the elongate dimension of the elements.

The outboard ends of the forward support element 550 and the aft support element 560 attach to the forward end of the oar support element 420 in such fashion that the forward support element 550 and the aft support element 560 can pivot in a horizontal plane with respect to the oar support element 420, as described in more detail herein and as shown in FIG. 4.

The aft end of the oar support element 420 attaches by a vertical pin 430 to a dual pivot element 350 in such fashion that the dual pivot element 350 can pivot in a horizontal plane with respect to the oar support element 420. The dual pivot element 350 attaches by a horizontal pin 355 to the outboard oar mounting bracket 320 of the oarlock assembly 300 in such fashion that the oarlock assembly 300 can pivot in a vertical plane with respect to the dual pivot element, as described in more detail herein and as shown in FIG. 7.

The forward end of the oar brace element 410 attaches to a point on the outboard half of the aft support element 560 in such fashion that the oar brace element 410 can pivot in both horizontal and vertical planes with respect to the aft support element 560, as described in greater detail herein and as shown in FIG. 6.

The aft end of the oar brace element 410 attaches to the inboard oar mounting bracket 310 of the oarlock assembly 300 such that the oar brace element 410 can pivot in both horizontal and vertical planes with respect to the oarlock assembly 300, as described in greater detail herein and as shown in FIG. 7.

Figure 8:
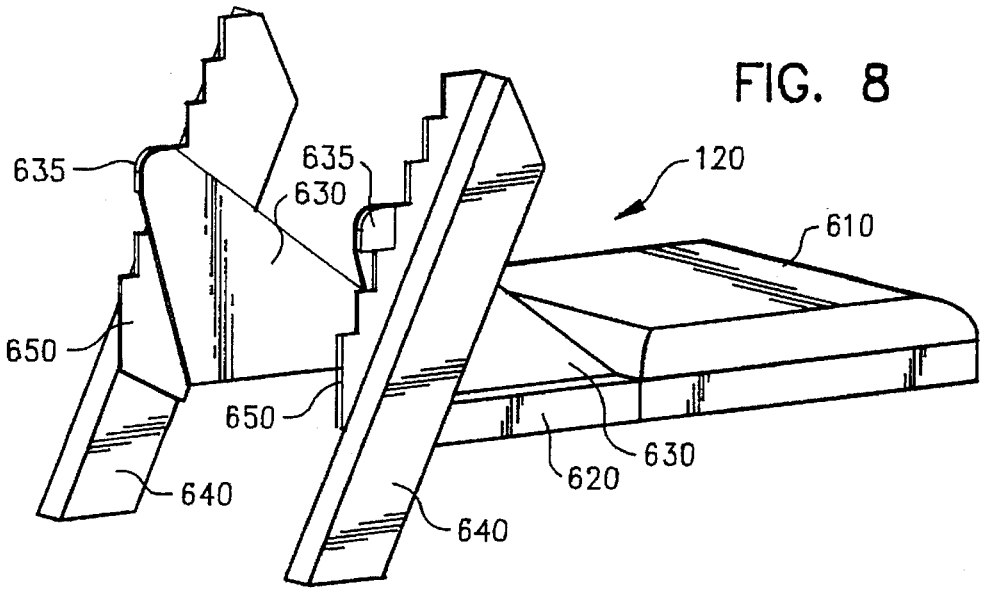
FIG. 8 is a view of the offset oar handle of the present invention, viewed at an angle 5 degrees above horizontal, and from the left at an angle 15 degrees clockwise from perpendicular to the vertical plane of the longitudinal axis of the oar, with the shaft of the oar being tilted toward the water at an angle of 17 degrees from horizontal, and the oar blade being vertical, as during the power stroke.

The oar shaft 160 is mounted through the oarlock assembly 300 in such fashion that the oar shaft 160 can rotate within the oarlock assembly but cannot slide through it. The oar blade 170 is aligned in the same plane with the offset oar handle 150, as described in greater detail herein and as shown in FIGS. 7 and 8.

Oak lock assembly 300, oar brace element 400, and oar support element 420 are collectively known as the Outboard Support Assembly. Aft support element 560 and forward support element 550 are collectively known as the Inboard Support Assembly.

Figure 3:
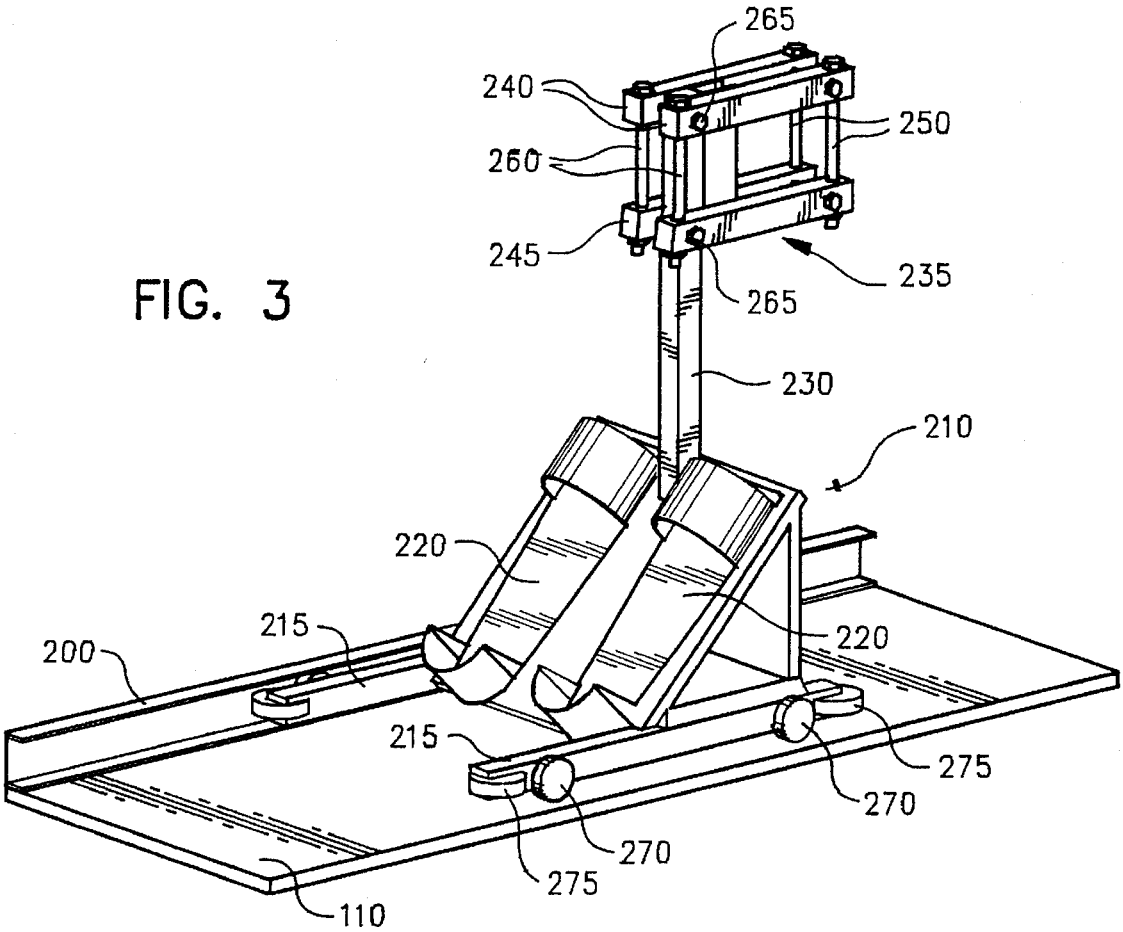
FIG. 3 is a partially exposed view of the stretcher assembly of the present invention, viewed at an angle 17 degrees above horizontal and from the boat starboard side at an angle 50 degrees counterclockwise from dead astern.

Referring to FIG. 3, stretcher assembly 210 is described in detail. Foot supports 220 are mounted at an angle on stretcher assembly 210 as they would be in a conventional sliding-seat rowing apparatus. At either side of the base of stretcher assembly 210 are fixed longitudinal elements 215, to which are mounted vertical rollers 270 and horizontal rollers 275, which roll within rail channels 200 mounted to the bottom of boat cockpit 110 on both sides of stretcher assembly 210. Support post 230 is rigidly mounted vertically in the middle of the forward end of stretcher assembly 210, and an inboard mounting bracket assembly 235 fits over its top.

Inboard mounting bracket assembly 235 has top horizontal elements 240 and bottom horizontal elements 245 which are clamped to support post 230 by pressure from lateral bolts 265. Height of inboard mounting bracket assembly 235 on support post 230 can be adjusted by loosening lateral bolts 265, sliding inboard mounting bracket assembly 235 along support post 230, and re-tightening lateral bolts 265. The inboard ends of forward support elements 550 join to inboard mounting bracket assembly 235 by means of vertical pins 250, and the inboard ends of aft support element 560 join to inboard mounting bracket assembly 235 by means of vertical pins 260.

Referring to FIG. 4, forward support element 550, aft support element 560, oar support element 420, and oar brace element 410 are described in detail. Forward support element 550 is adjustable in length, being fabricated from two sections of telescoping material, one of which may slide within the other until the two are fixed in relation to each other by screw or pin 552. Similarly, aft support element 560, oar support element 420, and oar brace element 410 are also adjustable in length, and are fixed in length by screws or pins 562, 422, and 412 respectively.

On the outboard portion of aft support element 560, brace mounting bracket 565 is secured by clamp 570, and the position of oar brace mounting bracket 565 can be adjusted by loosening clamp 570, moving oar brace mounting bracket 565, and re-tightening clamp 570.

Forward support mounting bracket 450 is fixably secured to the forward portion of oar support element 420. Aft support mounting bracket 460 is secured by clamps 470 to the forward portion of oar support element 420, and the position of aft support mounting bracket 460 on oar support element 420 can be adjusted by loosening clamps 470, moving aft support mounting bracket 460, and re-tightening clamps 470.

The outboard ends of forward support element 550 and aft support element 560, shown at the right side of FIG. 4, are joined to oar support element 420 at forward support mounting bracket 450 and aft support mounting bracket 460 respectively, by means of vertical pins 455 and 465 respectively.

The forward end of oar brace element 410, shown at the left side of FIG. 4, is flexibly joined to aft support element 560 at oar brace mounting bracket 565; the hole in forward end of oar brace element 410 is large enough to permit oar brace element 410 to pivot about pin in oar brace mounting bracket 565 in both vertical and horizontal planes.

Dual pivot element 350 joins aft end of oar support element 420 by means of vertical pin 430, and joins outboard oar mounting bracket 320 by means of horizontal pin 355.

Referring to FIG. 5, the attachment of forward support elements 550 and aft support elements 560 to support post 230 is described in detail. Inboard mounting bracket assembly 235 has top horizontal elements 240 and bottom horizontal elements 245 which are clamped to support post 230 by pressure from lateral bolts 265. The inboard ends of forward support elements 550 join to inboard mounting bracket assembly 235 by means of vertical pins 250, and the inboard ends of aft support element 560 join to inboard mounting bracket assembly 235 by means of vertical pins 260.

Referring to FIG. 6, the attachment of forward support element 550 and aft support element 560 to oar support element 420, and the attachment of oar brace element 410 to aft support element 560 is described in detail. Forward support mounting bracket 450 is fixably secured to the forward portion of oar support element 420. Aft support mounting bracket 460 is secured by clamps 470 to the forward portion of oar support element 420, and the position of aft support mounting bracket 460 on oar support element 420 can be adjusted by loosening clamps 470, moving aft support mounting bracket 460, and re-tightening clamps 470. The outboard ends of forward support element 550 and aft support element 560 are joined to oar support element 420 at forward support mounting bracket 450 and aft support mounting bracket 460 respectively by means of vertical pins.

On the outboard portion of aft support element 560, brace mounting bracket 565 is secured by clamp 570. The position of oar brace mounting bracket 565 on aft support element 560 can be adjusted by loosening clamp 570, moving oar brace mounting bracket 565, and re-tightening clamp 570.

The forward end of oar brace element 410 is flexibly joined to aft support element 560 at oar brace mounting bracket 565; the hole in forward end of oar brace element 410 is large enough to permit oar brace element 410 to pivot about pin in oar brace mounting bracket 565 in both vertical and horizontal planes.

Referring to FIG. 7, the oarlock assembly 300 and the attachment of oarlock assembly 300 to oar support element 420 and to oar brace element 410 are described in detail. Outer tube 305 rotates freely around inner tube 390, which is fixed to oar shaft 160. Outboard end tube 380 and inboard end tube 385 are fixed to inner tube 390 and prevent outer tube 305 from sliding along inner tube 390.

Outboard oar mounting bracket 320 is fixed to outer tube 305 by clamps 370, and inboard oar mounting bracket 310 is fixed to outer tube 305 by clamps 360. The position of outboard oar mounting bracket 320 and inboard oar mounting bracket 310 with respect to outer tube 305 can be adjusted by loosening clamps 370 and 360 respectively.

Outboard oar mounting bracket 320 joins dual pivot element 350 by means of horizontal pin 355. Aft end of oar support element 420 joins dual pivot element 350 by means of vertical pin 430. Hole in aft end of oar brace element 410 is mounted over "D" ring of inboard oar mounting bracket 310.

Referring to FIG. 8, the offset oar handle 150 is described in detail. The oar handle grip 150 is joined at right angles to offset segment 153. Offset segment 155 is joined to oar shaft 160 at an angle of between about 115 degrees and about 145 degrees, and preferably about 140 degrees, such that when oar blade 170 is in the water during power stroke, and oar shaft 160 is inclined at an angle of approximately 15 degrees from horizontal, oar handle grip 150 lies in a vertical plane parallel to the vertical plane of oar blade 170, and is preferably inclined at an angle of approximately 65 degrees from horizontal. Offset segment 155 has a length such that the rower's hand can be centered on the offset oar handle 150 at the point where the central axis of oar shaft 160 would intersect the central axis of offset oar handle 150. The angles given here may vary with rowers' preferences regarding comfort in rotating oar shaft 160 for "feathering" such that oar handle grip 150 may be inclined at an angle from horizontal between 40 degrees and 70 degrees, instead of the 65 degree angle shown in FIG. 8.

Figure 9:
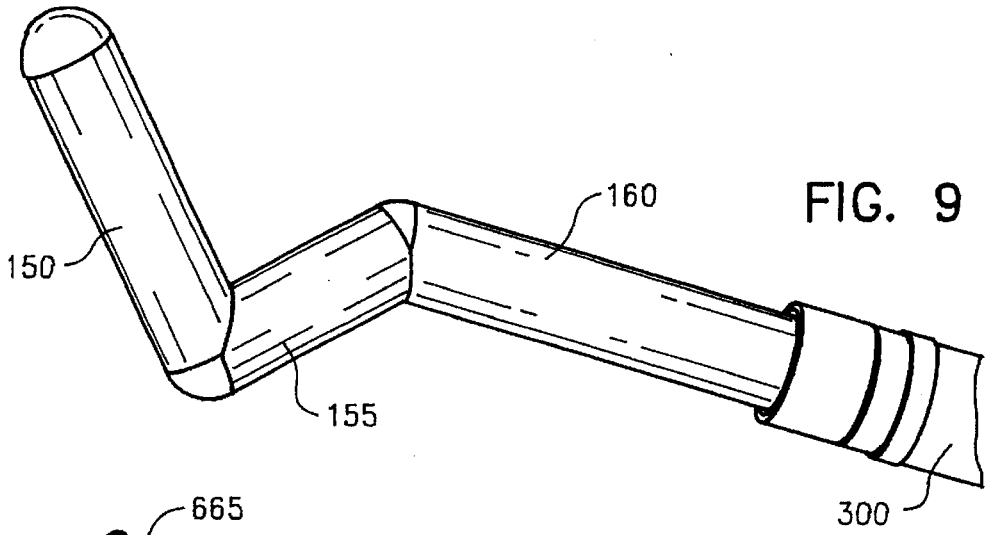
FIG. 9 is a partially exposed view of a seat assembly of the present invention in which the seat height is adjustable by the rower, viewed at an angle 10 degrees above horizontal and from the starboard side at an angle 55 degrees counterclockwise from dead astern.

Referring to FIG. 9, the height adjustment mechanism for the seat assembly 120 is described in detail. Seat platform 610 is mounted on horizontal seat supports 620, to which are joined seat support plates 630. Seat step blocks 635 are fixed on seat support plates 630. Seat step plates 650 are mounted on seat support risers 640. Seat platform 610 is fixed in position when seat step blocks 635 rest on seat step plates 650 and the aft ends of horizontal seat supports 620 rest against seat support risers 640. Seat height may be changed by lifting forward end of seat platform 610, which swings seat step blocks 635 off of seat step plates 650, which allows horizontal seat supports 620 to slide along seat support risers 640 to a higher or lower position. When forward end of seat platform 610 is lowered once more, seat step blocks 635 swing back onto steps of seat step plates 650, locking seat into position.

Figure 10:
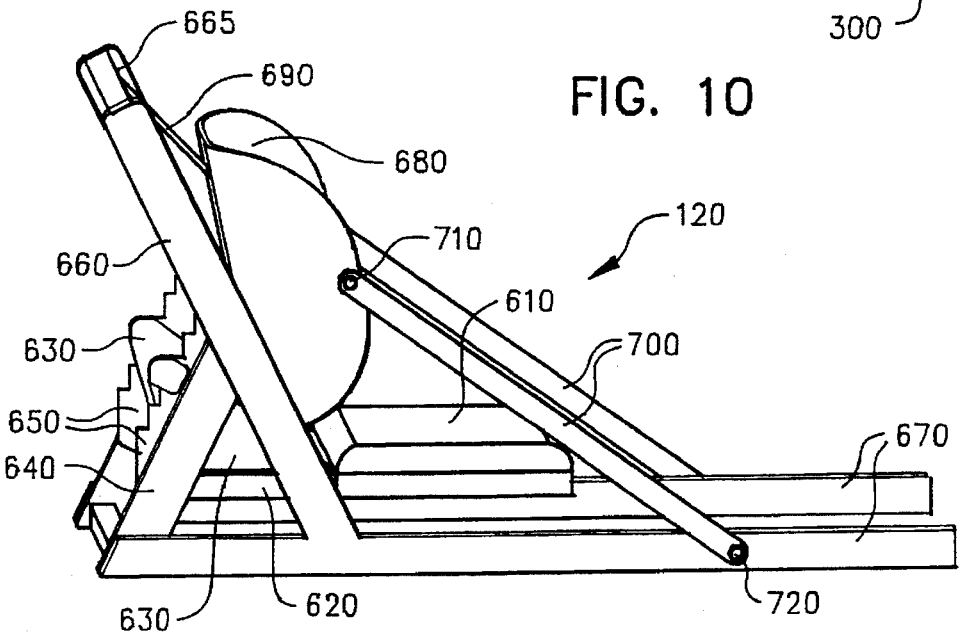
FIG. 10 is a view of a seat assembly of the present invention in which the height is adjustable by the rower, viewed at an angle 10 degrees above horizontal and from the starboard side at an angle 85 degrees counterclockwise from dead astern, and showing a back support which pivots to conform to different angles of the rower's back.

Referring to FIG. 10, the seat assembly 120 with height adjustment and a pivoting back support 680 is described in detail. As in FIG. 9, seat platform 610 is mounted on horizontal seat supports 620, to which are joined seat support plates 630. Seat step plates 650 are mounted on seat support risers 640. Seat back risers 660, joined to seat rails 670, are fixed to sides of seat support risers 640. Rear of back support 680 is attached to crosspiece 665 by cord 690. Both sides of back support 680 are pivotally attached to aft ends of seat braces 700 by pins or rivets 710, while forward ends of seat braces 700 are pivotally attached to seat rails 670 by pins or bolts 720. Back support 680 thus can pivot to conform with rower's back as the angle of rower's back changes during the stroke.

Figure 1B:
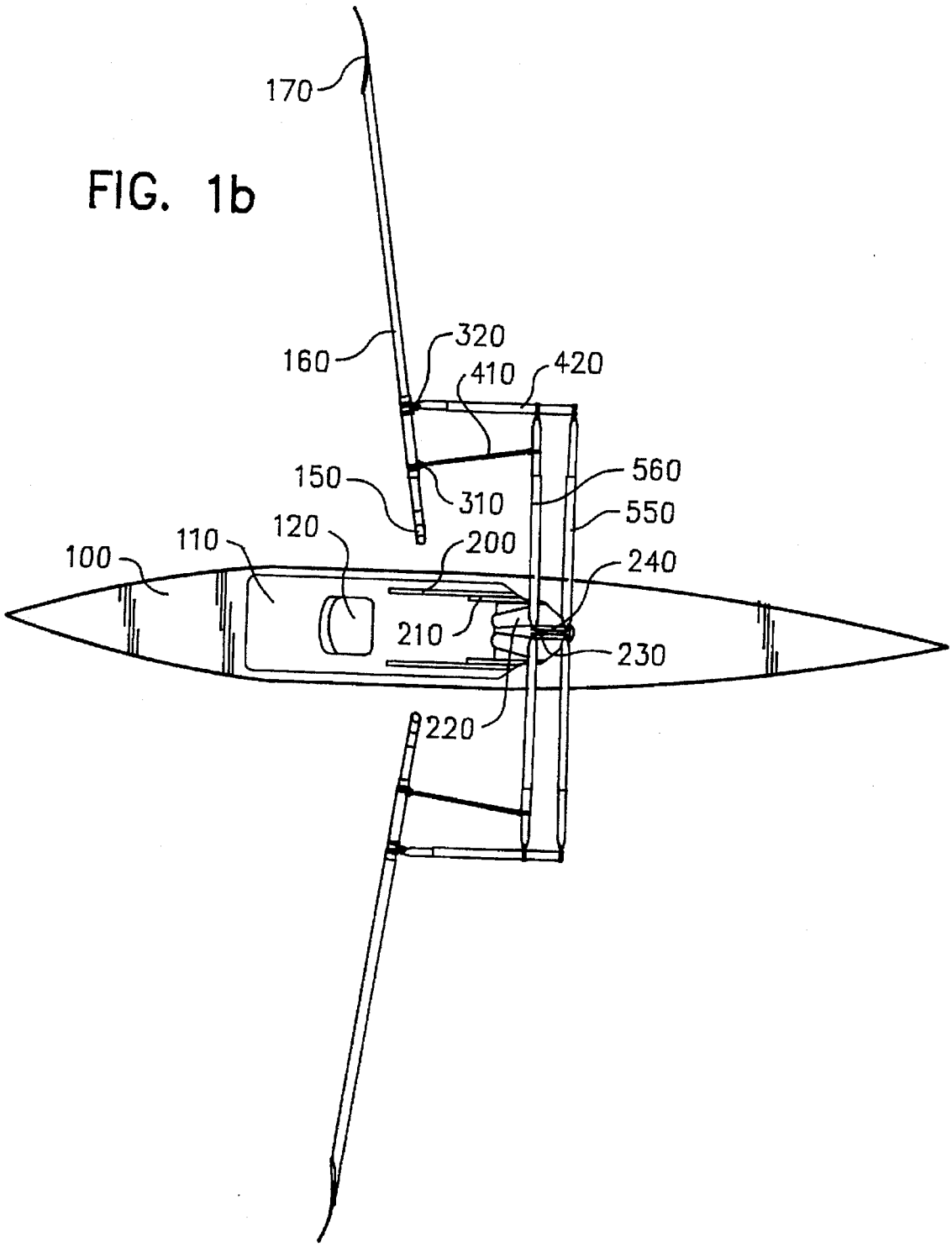
Figure 1C:
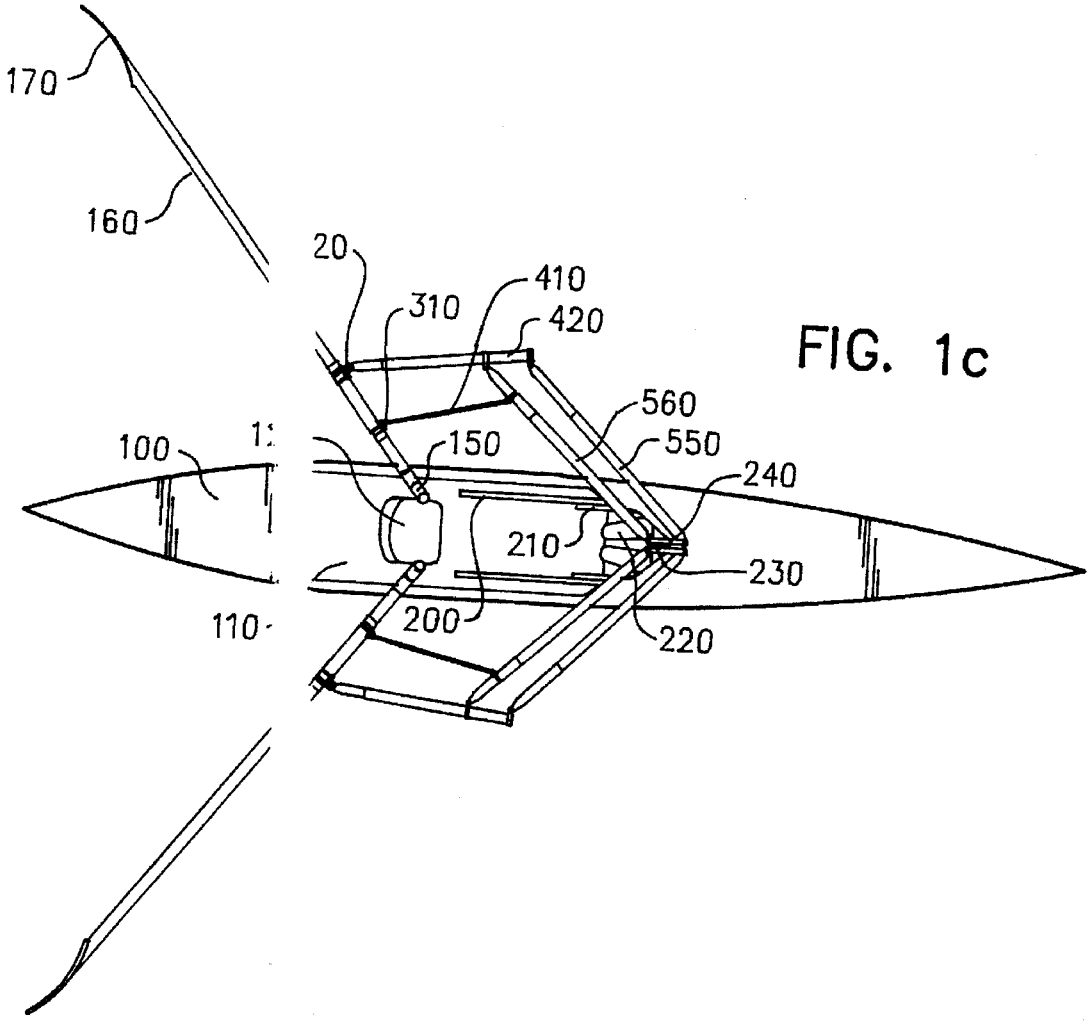
Figure 2A:
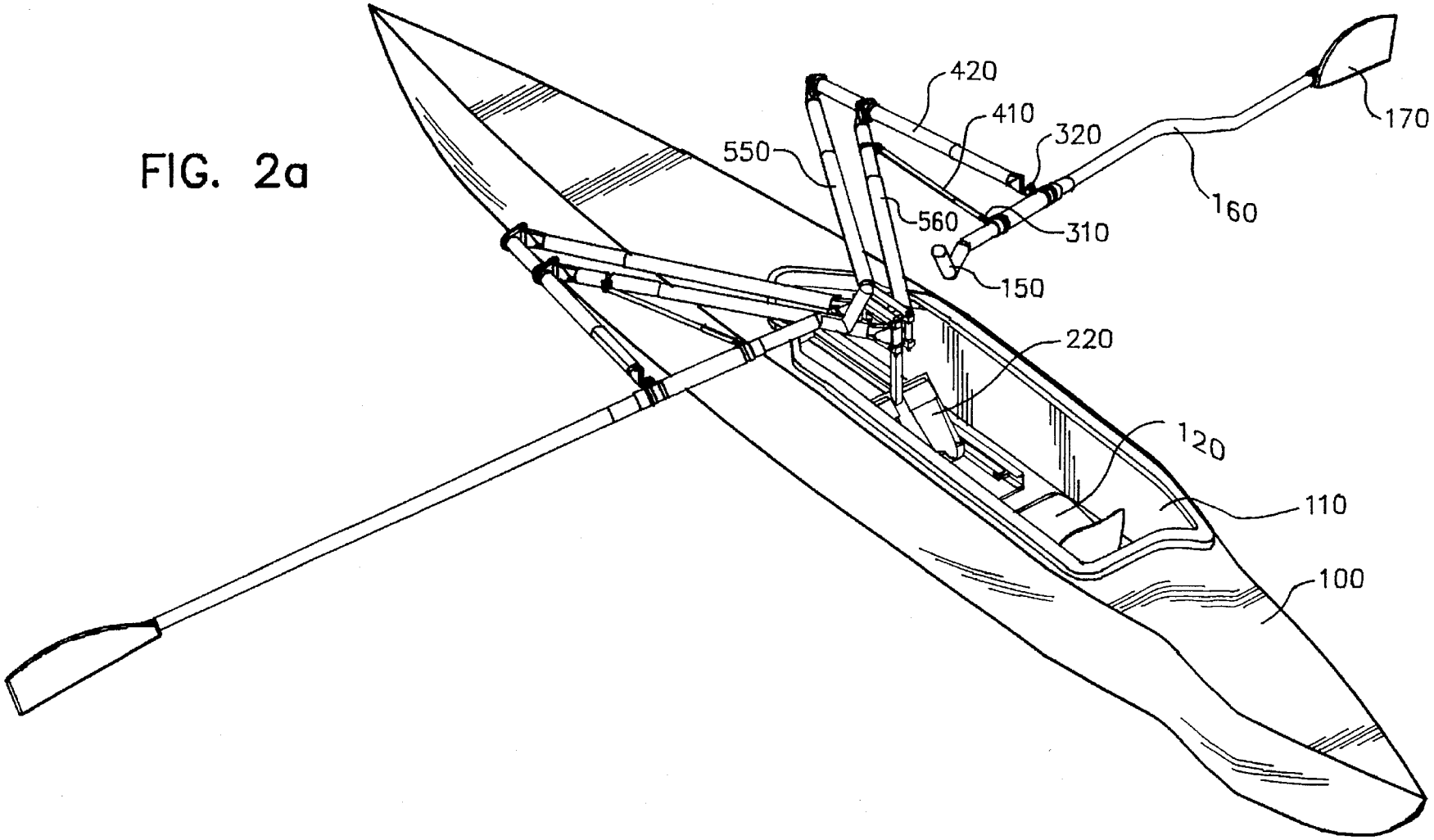
FIGS. 2*a*, 2*b*, 2*c*, and 2*d* are views of the present invention mounted on a boat, viewed at an angle 38 degrees above horizontal and from the port side of the boat at an angle 40 degrees clockwise from dead astern, and showing respectively the beginning, middle, and end positions of the oar power stroke and the position of the apparatus when the oars have just been raised from the water and feathered after the power stroke.

Referring now to FIGS. 1*a*, 1*b*, 1*c*, 2*a*, 2*b*, 2*c*, and 2*d*, the rowing operation of the present invention is described. The oarsman is situated on seat assembly 120, facing toward the front of the boat. FIGS. 1*a* and 2*a* show the beginning of an exemplary oar power stroke. Immediately prior to the beginning of such stroke, stretcher assembly 210 is positioned at the aft end of rail channels 200 as shown in FIG. 3; the oarsman's legs are bent so that his knees are close to his chest, and his body and arms are extended forward. The oarsman grasps oar handles 150 such that the handles 150 are in a horizontal plane and the oarsman's knuckles are facing upwards. The oar blades 170 are thus also horizontal relative to the water, with the aft face of oar blades 170 facing upwards. The oarsman's hands are held low so that the oar shafts 160, by pivoting at outboard oar mounting bracket 320, hold the oar blades 170 out of the water.

To initiate the oar power stroke, the oarsman rotates his wrists and hands backwards so that the oar handles 150 are in a vertical plane, causing the oar blades 170 to rotate to a vertical plane as a result of the transfer of rotation through oar shaft 160. In the same motion, the oarsman raises his hands to his chest level, thus raising the oar handles 150, causing oar shafts 160 to pivot in a vertical plane around outboard oar mounting bracket 320, and to lower the oar blades 170 into the water. In the resulting position, shown in FIGS. 1*a* and 2*a*, the oarsman is at the start of the oar power stroke, with the oar blades 170 in the water.

Figure 2B:
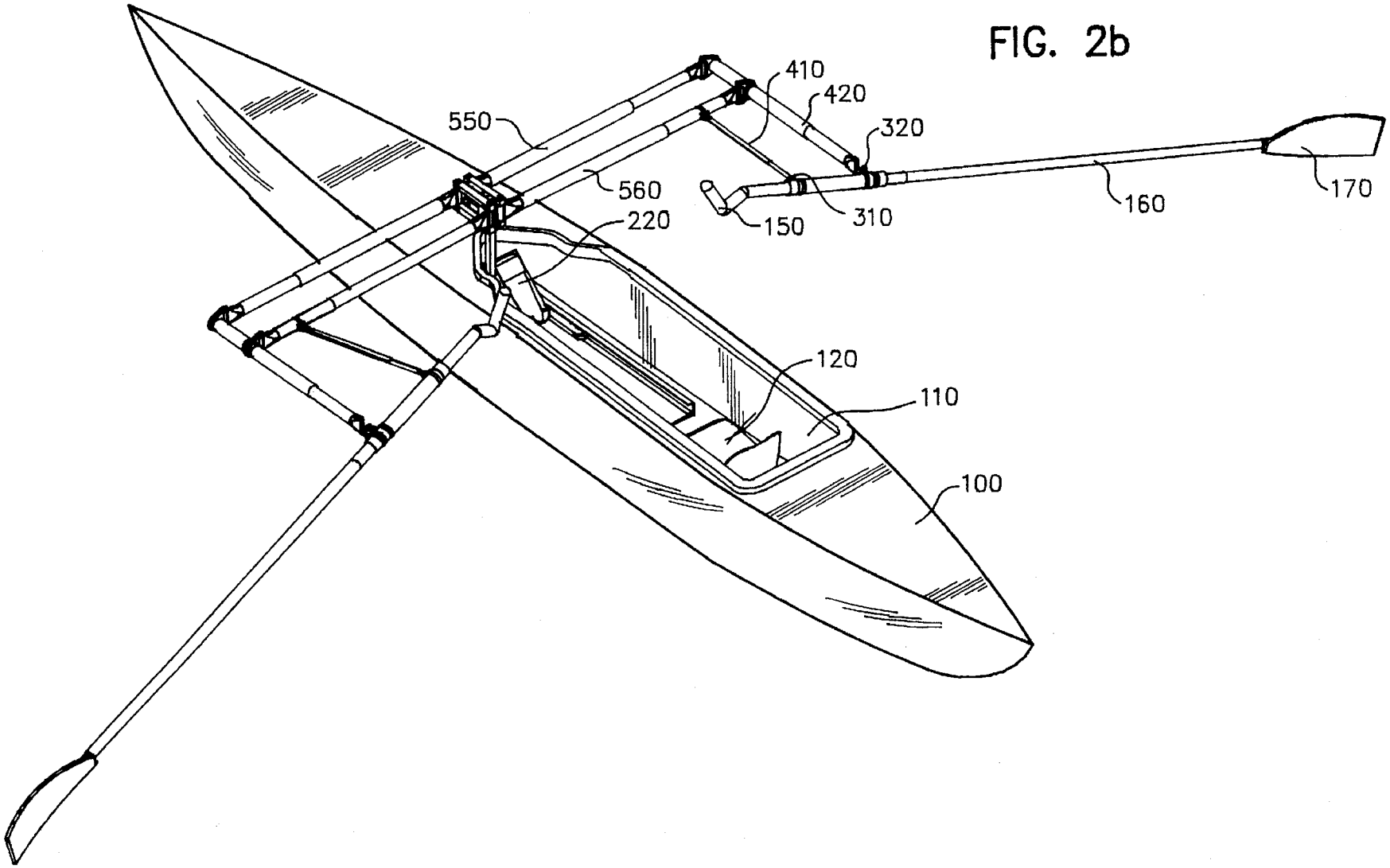

As shown in FIGS. 1*b* and 2*b*, keeping his arms straight, the oarsman straightens his back and thrusts with his legs, sliding stretcher assembly 210 along rail channels 200 towards the front of boat 100, and moving handles 150 towards the stern of boat 100. Oar handles 150 also move apart from support post 230, placing the oar brace elements 410 under tension, which causes the aft support elements 560 and the forward support elements 550 to pivot around their inboard ends so that their outboard ends move aft. Tension on the forward support elements 550 and compression on the aft support elements 560 constrain the oar support elements 420 to pivot so that their aft ends move in an inboard direction. Compression on the oar support elements 420, combined with the tension on the oar brace elements 410, cause the oar shaft 160 to pivot in a horizontal plane around the outboard oar mounting bracket 320 so that oar blades 170 are forced to move aft, towards the stern of boat 100. FIGS. 1*b* and 2*b* show a point in the exemplary oar power stroke when the oarsman has used the above actions to move the forward support elements 550 perpendicular to boat 100. From this point, the oarsman continues to straighten his back and to thrust with his legs. In addition, he bends his arms so as to bring his hands closer to his chest. All of these motions move handles 150 toward the stern of boat 100.

Figure 2C:
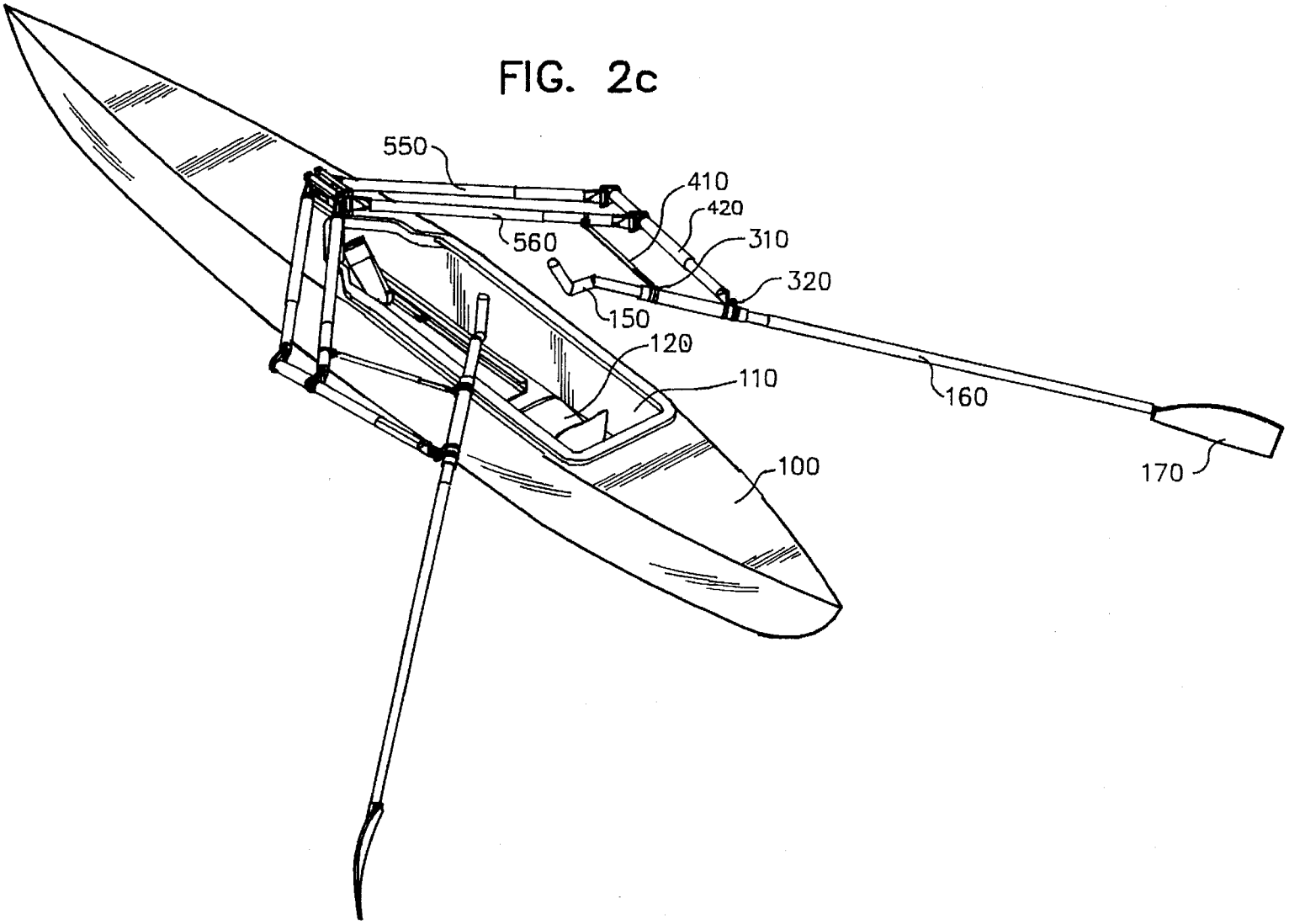

At the end of the power stroke, shown in FIGS. 1*c* and 2*c*, stretcher assembly 210 is at the front of rail channels 200, and oarsman's legs are fully extended. Oar shafts 160, forward support elements 550, and aft support elements 560 are oriented towards the stern of boat 100. Oarsman's back is straight and slightly toward the stern of boat 100, and oarsman's hands are close to his chest.

Figure 2D:
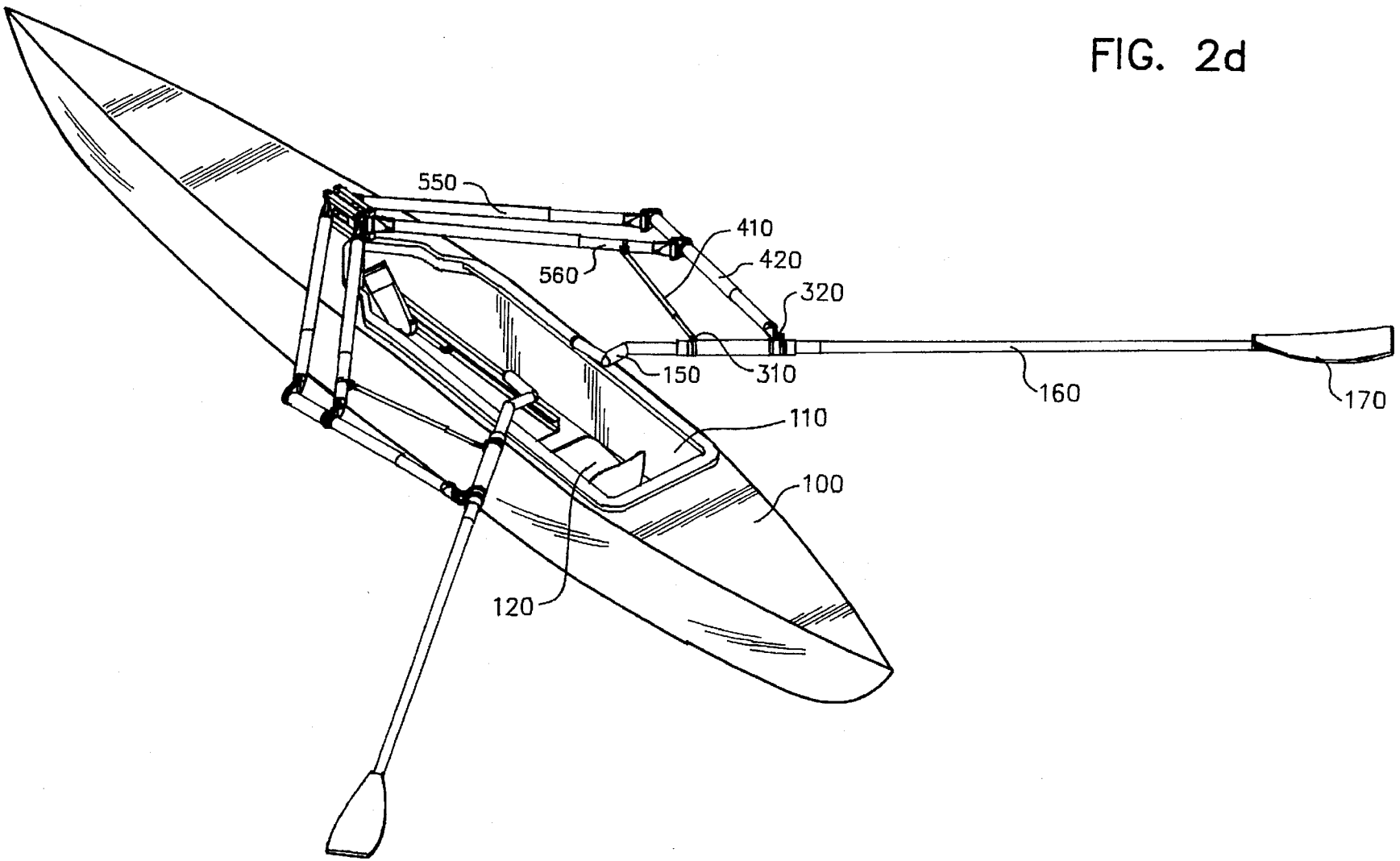

As shown in FIG. 2*d*, the oarsman now drops his hands from his chest towards his lap, thus lowering oar handles 150, causing oar shaft 160 to pivot in a vertical plane around outboard oar mounting bracket 320, and raising oar blade 170 out of the water. In the same motion, the oarsman rotates his wrists and hands forwards so that the oar handles 150 are in a horizontal plane again. This wrist and hand motion again causes oar blades 170 to rotate to a horizontal plane. In the resulting position, the oarsman is at the start of the recovery stroke.

In the recovery stroke, the oarsman leans his back forward and pushes his hands forward over his knees, then bends his legs, sliding stretcher assembly 210 aft on rail channels 200. The oarsman's body and arm motion pushes handles 150 away from him and towards the front of boat 100, while his leg motion draws support post 230 towards the stern of boat 100. As oar handles 150 approach support post 230, the oar brace elements 410 are placed under compression, which causes the aft support elements 560 and the forward support elements 550 to pivot around their inboard ends so that their outboard ends move forwards. Compression on the forward support elements 550 and tension on the aft support elements 560 now constrain the oar support elements 420 to pivot so that their aft ends move in an outboards direction. Tension on the oar support elements 420, combined with the compression on the oar brace elements 410, cause the oar shaft 160 to pivot in a horizontal plane around the outboard oar mounting bracket 320 so that oar blades 170 move forwards, toward the front of boat 100. By this motion, the apparatus returns to the starting stroke orientation initially described above.

Figure 11:
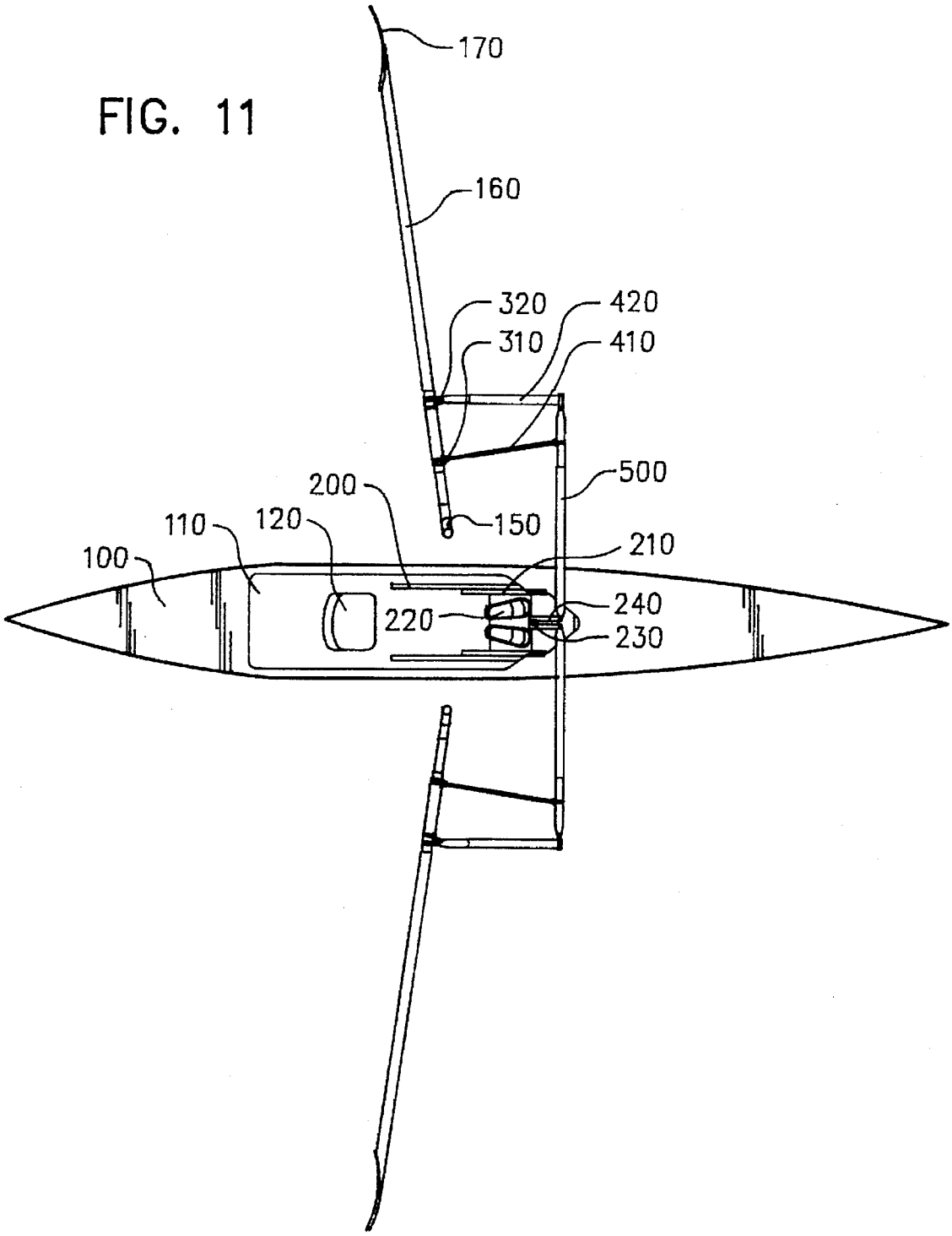
FIG. 11 is a top view of a second embodiment of the present invention and showing a position during the middle of the oar power stroke.

Referring to FIG. 11, a second embodiment of the present invention is described in detail. Comparing FIG. 11 to FIG. 1*b*, all parts of the figures are the same except for the Inboard Support Assembly, which in this alternate embodiment consists of one support element 500 rather than of a forward support element 550 and of an aft support element 560 in the preferred embodiment.

Figure 12:
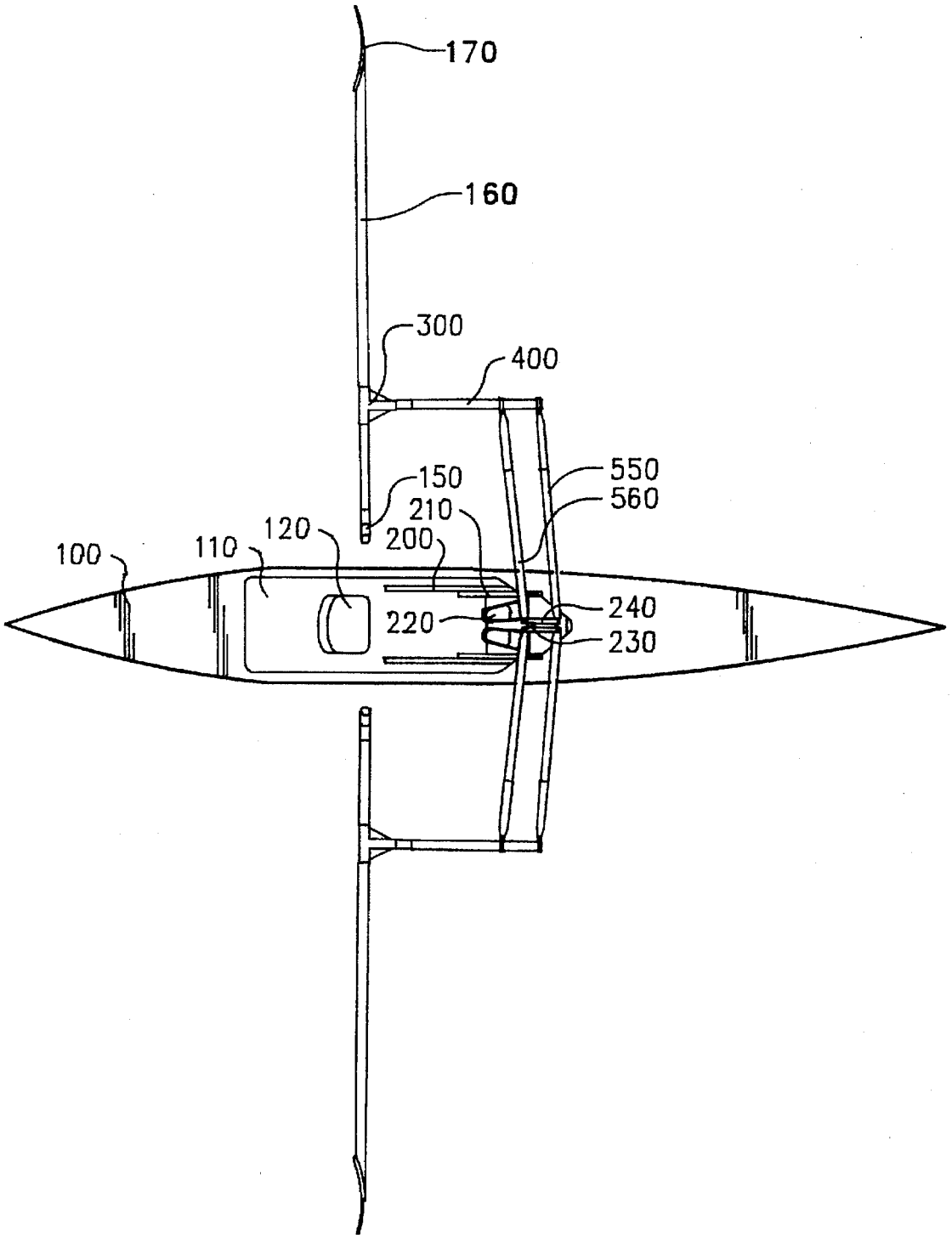
FIG. 12 is a top view of a third embodiment of the present invention and showing a position during the middle of the oar power stroke.

Referring to FIG. 12, a third embodiment of the present invention is described in detail. Comparing FIG. 12 to FIG. 1*b*, all parts of the figures are the same except for the Outboard Support Assembly and oarlock assembly 300. In this alternate embodiment, the Outboard Support Assembly consists of one support element 400 rather than of an oar support element 420 and of an oar brace element 410 in the preferred embodiment. Also in this alternate embodiment, the oarlock assembly 300 consists of two lengths of tube joined rigidly in a "T" shape, with the oar shaft 160 rotating within, but not sliding through, the tube that forms the top of the "T" and the upright of the "T" rotating around, but not sliding along, the oar support element 400.

Figure 13:
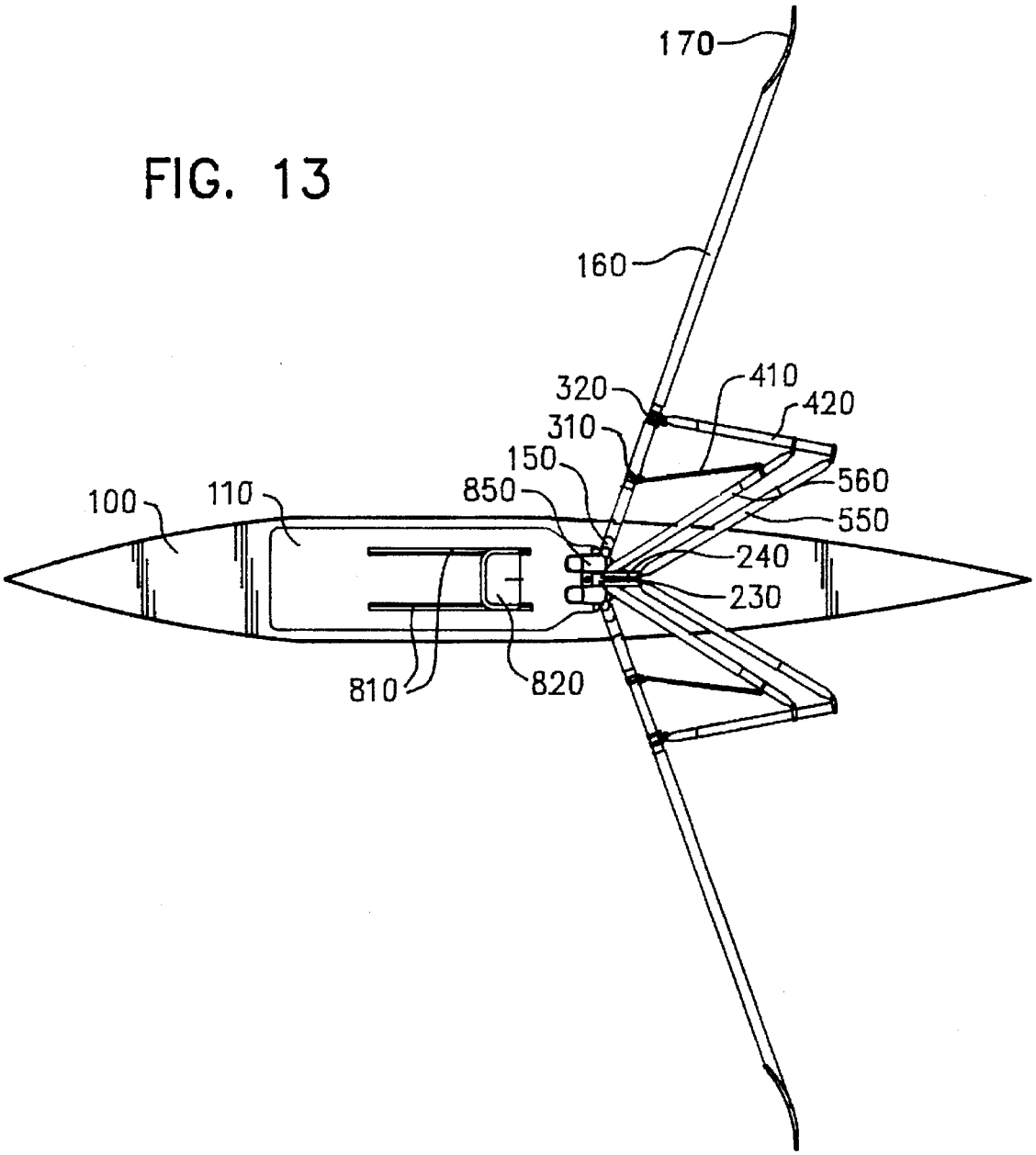
FIG. 13 is a top view of a fourth embodiment of the present invention and showing a position at the start of the oar power stroke.

Referring to FIG. 13, a fourth embodiment of the present invention is described in detail. Comparing FIG. 12 to FIG. 1*a*, all parts of the figures are the same except for the seat assembly and stretcher assembly. In this alternate embodiment, the stretcher assembly 850 to which the support post 230 is attached is itself fixed to the boat, rather than sliding as it does in the preferred embodiment. Also in this alternate embodiment, the seat 820 slides on rails 810 in a manner conventional to sliding-seat rowing.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the spirit and scope of the invention.

I claim:

1. A boat for forward facing rowing having a bow and having oars mounted ahead of the oarsman, said boat further comprising:

a seat facing said boat bow and fixedly secured in said boat;

inboard support assembly means slidably secured in said boat for longitudinal sliding movement of said inboard support assembly means, said inboard support assembly means in its entirety being longitudinally slidable in said boat; and outboard support assembly means pivotally connected to said inboard support assembly means for horizontal movement of said outboard support assembly means, said outboard support assembly means connected to said boat oars for pivotal movement of said boat oars with respect to said outboard support assembly means in at least horizontal and vertical planes and for rotational movement of said boat oars with respect to said outboard support assembly means.

2. The boat of claim 1 wherein said inboard support assembly means comprises:

mounting bracket means slidably secured within said boat; and first elongate support means pivotally attached to said mounting bracket means for horizontal movement of said first elongate support means.

3. The boat of claim 2 wherein said inboard support assembly means further comprises:

second elongate support means pivotally attached to said mounting bracket means for horizontal movement of said second elongate support means.

4. The boat of claim 2 wherein said first elongate support means is adjustable in length.

5. The boat of claim 3 wherein said second elongate support means is adjustable in length.

6. The boat of claim 2 wherein said outboard support assembly means comprises:

oar support means pivotally connected to said first elongate support means for at least horizontal movement of said oar support means, said oar support means pivotally connected to said boat oars for movement of said boat oars with respect to said oar support means in at least horizontal and vertical planes and for rotational movement of said boat oars with respect to said oar support means.

7. The boat of claim 6 wherein said oar support means is adjustable in length.

8. The boat of claim 6 wherein said pivotal connection of said oar support means to said first elongate support means is adjustable along said oar support means.

9. The boat of claim 2 wherein said outboard support assembly means further comprises:

oar brace means pivotally connected to said first elongate support means for at least horizontal and vertical movement of said oar brace means, said oar brace means pivotally connected to said boat oars for movement of said boat oars in at least horizontal and vertical planes and for rotational movement of said boat oars with respect to said oar brace means.

10. The boat of claim 9 wherein said oar brace means is adjustable in length.

11. The boat of claim 9 wherein said pivotal connection of said oar brace means to said first elongate support means is adjustable along said first elongate support means.

12. The boat of claim 3 wherein said outboard support assembly means comprises:

oar support means pivotally connected to said first elongate support means and to said second elongate support means for at least horizontal movement of said oar support means, said oar support means pivotally connected to said boat oars for movement of said boat oars with respect to said oar support means in at least horizontal and vertical planes and for rotational movement of said boat oars with respect to said oar support means.

13. The boat of claim 12 wherein said first elongate support means is adjustable in length.

14. The boat of claim 12 wherein said second elongate support means is adjustable in length.

15. The boat of claim 12 wherein said oar support means is adjustable in length.

16. The boat of claim 12 wherein said pivotal connection of said oar support means to said first elongate support means is adjustable along said oar support means.

17. The boat of claim 12 wherein said outboard support assembly means further comprises:

oar brace means pivotally connected to said first elongate support means for at least horizontal and vertical movement of said oar brace means, said oar brace means pivotally connected to said boat oars for movement of said boat oars with respect to said oar support means in at least horizontal and vertical planes and for rotational movement of said boat oars with respect to said oar brace means.

18. The boat of claim 17 wherein said oar brace means is adjustable in length.

19. The boat of claim 17 wherein said pivotal connection of said oar brace means to said first elongate support means is adjustable along said first elongate support means.

20. A boat for forward facing rowing having oars mounted ahead of the oarsman and having a seat fixedly secured in said boat, said boat further comprising:

inboard support assembly means slidably secured in said boat for longitudinal sliding movement of said inboard support assembly means; and outboard support assembly means pivotally connected to said inboard support assembly means for horizontal movement of said outboard support assembly means, said outboard support assembly means pivotally connected to said boat oars, wherein said inboard support assembly means comprises mounting bracket means slidably secured within said boat, first elongate support means pivotally attached to said mounting bracket means for horizontal movement of said first elongate support means, and second elongate support means pivotally attached to said mounting bracket means for horizontal movement of said second elongate support means, and said outboard support assembly means comprises oar support means pivotally connected to said first elongate support means and to said second elongate support means for at least horizontal movement of said oar support means, said oar support means pivotally connected to said boat oars, and oar brace means pivotally connected to said first elongate support means for at least horizontal and vertical movement of said oar brace means, said oar brace means pivotally connected to said boat oars for movement of said boat oars with respect to said oar support means and said oar brace means in at least horizontal and vertical planes and for rotational movement of said boat oars with respect to said oar brace means.

21. A boat for forward facing rowing having oars mounted ahead of the oarsman and having a seat fixedly secured in said boat, said boat further comprising:

inboard support assembly means slidably secured in said boat for longitudinal sliding movement of said inboard support assembly means; and outboard support assembly means pivotally connected to said inboard support assembly means for horizontal movement of said outboard support assembly means, said outboard support assembly means pivotally connected to said boat oars, wherein said inboard support assembly means comprises mounting bracket means slidably secured within said boat, first elongate support means pivotally attached to said mounting bracket means for horizontal movement of said first elongate support means, and said outboard support assembly means comprises oar support means pivotally connected to said first elongate support means and to said second elongate support means for at least horizontal movement of said oar support means, said oar support means pivotally connected to said boat oars, and oar brace means pivotally connected to said first elongate support means for at least horizontal and vertical movement of said oar brace means, said oar brace means pivotally connected to said boat oars for movement of said boat oars with respect to said oar support means and said oar brace means in at least horizontal and vertical planes and for rotational movement of said boat oars with respect to said oar brace means.

22. A boat for forward facing rowing having a bow and having oars mounted ahead of the oarsman, said boat further comprising:

a seat facing said boat bow and fixedly secured in said boat;

inboard support assembly means slidably secured in said boat for longitudinal sliding movement of said inboard support assembly means, said inboard support assembly means in its entirety being longitudinally slidable in said boat; and outboard support assembly means pivotally connected to said inboard support assembly means for horizontal movement of said outboard support assembly means, said outboard support assembly means pivotally connected to boat oars, wherein said inboard support assembly means comprises mounting bracket means slidably secured within said boat, first elongate support means pivotally attached to said mounting bracket means for horizontal movement of said first elongate support means, and second elongate support means pivotally attached to said mounting bracket means for horizontal movement of said second elongate support means, and said outboard support assembly means comprises oar support means pivotally connected to said first elongate support means and to said second elongate support means for at least horizontal movement of said oar support means, said oar support means pivotally connected to said boat oars for movement of said boat oars with respect to said oar support means in at least horizontal and vertical planes and for rotational movement of said boat oars with respect to said oar support means.

23. A boat for forward facing rowing having oars mounted ahead of the oarsman and having a seat fixedly secured in said boat, said boat further comprising:

inboard support assembly means slidably secured in said boat for longitudinal sliding movement of said inboard support assembly means; and outboard support assembly means pivotally connected to said inboard support assembly means for horizontal movement of said outboard support assembly means, said outboard support assembly means pivotally connected to said boat oars, wherein said inboard support assembly means comprises mounting bracket means slidably secured within said boat, and first elongate support means pivotally attached to said mounting bracket means for horizontal movement of said first elongate support means, and said outboard support assembly means comprises oar brace means pivotally connected to said first elongate support means for at least horizontal and vertical movement of said oar brace means, said oar brace means pivotally connected to said boat oars for movement of said boat oars with respect to said oar brace means in at least horizontal and vertical planes and for rotational movement of said boat oars with respect to said oar brace means.

24. A boat for forward facing rowing having oars mounted ahead of the oarsman and having a seat fixedly secured in said boat, said boat further comprising:

inboard support assembly means slidably secured in said boat for longitudinal sliding movement of said inboard support assembly means; and outboard support assembly means pivotally connected to said inboard support assembly means for horizontal movement of said outboard support assembly means, said outboard support assembly means pivotally connected to said boat oars, wherein said inboard support assembly means comprises mounting bracket means slidably secured within said boat, first elongate support means pivotally attached to said mounting bracket means for horizontal movement of said first elongate support means, and second elongate support means pivotally attached to said mounting bracket means for horizontal movement of said second elongate support means, said outboard support assembly means comprises oar support means pivotally connected to said first elongate support means and to said second elongate support means for at least horizontal movement of said oar support means, said oar support means pivotally connected to said boat oars, and oar brace means pivotally connected to said first elongate support means for at least horizontal and vertical movement of said oar brace means, said oar brace means pivotally connected to said boat oars for movement of said boat oars with respect to said oar support means and said oar brace means in at least horizontal and vertical planes and for rotational movement of said boat oars with respect to said oar brace means.

* * * * *